US008314821B2

(12) United States Patent
Morrison

(10) Patent No.: US 8,314,821 B2
(45) Date of Patent: Nov. 20, 2012

(54) METHOD OF CONTROLLING THERMAL PRINTING

(75) Inventor: Randall L. Morrison, Oviedo, FL (US)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 12/951,316

(22) Filed: Nov. 22, 2010

(65) Prior Publication Data

US 2011/0063394 A1 Mar. 17, 2011

Related U.S. Application Data

(63) Continuation of application No. 12/211,974, filed on Sep. 17, 2008, now Pat. No. 7,839,425.

(51) Int. Cl.
*B41J 3/60* (2006.01)
*B41J 2/35* (2006.01)

(52) U.S. Cl. ..... 347/171

(58) Field of Classification Search ..... 347/171, 347/180, 181, 182, 188; 400/82, 188
See application file for complete search history.

(56) References Cited

U.S. PATENT DOCUMENTS

| | | | | |
|---|---|---|---|---|
| 3,466,423 | A | 9/1969 | Janning | |
| 3,518,406 | A | 6/1970 | Janning | |
| 3,947,854 | A | 3/1976 | Hansen et al. | |
| 4,167,392 | A | 9/1979 | Defago | |
| RE30,116 | E | 10/1979 | Maalouf | |
| 4,309,255 | A | 1/1982 | Gendler et al. | |
| 4,507,669 | A | 3/1985 | Sakamoto et al. | |
| 4,631,596 | A | 12/1986 | Yaguchi | |
| 4,708,500 | A | 11/1987 | Bangs et al. | |
| 4,751,520 | A * | 6/1988 | Mizoguchi | 347/188 |
| 4,843,409 | A * | 6/1989 | Matsuzaki | 347/172 |
| 4,956,251 | A | 9/1990 | Washizu et al. | |
| 4,965,166 | A | 10/1990 | Hosoi et al. | |
| 5,055,373 | A | 10/1991 | Saeki et al. | |
| 5,099,258 | A * | 3/1992 | Hirayama | 347/188 |
| 5,101,222 | A | 3/1992 | Hakkaku | |
| 5,132,704 | A | 7/1992 | Nakagawa | |

(Continued)

FOREIGN PATENT DOCUMENTS

EP 0 947 340 A2 10/1999

(Continued)

OTHER PUBLICATIONS

JP Abstract, vol. 007, No. 063 (M-200), Mar. 16, 1983 & JP 572-208298 A (Ricoh KK), Dec. 21, 1982.

(Continued)

*Primary Examiner* — Huan Tran

(74) *Attorney, Agent, or Firm* — Paul W. Martin; Dana T. Hustins

(57) ABSTRACT

A method of controlling thermal printing based upon print density. The method includes receiving pre-formatted data representing information to be printed on two sides of a thermal print media from a computer by a processor of a thermal printer, analyzing the pre-formatted data by the thermal printer to determine different types of data to be printed with different print densities by the processor, determining an average print density of the different print densities by the processor, determining that the average print density is greater than a predetermined average print density by the processor, determining a power level required to print the data, and directing first and second thermal print heads to print the data based upon the required power level by the processor.

9 Claims, 2 Drawing Sheets

U.S. PATENT DOCUMENTS

| | | | |
|---|---|---|---|
| 5,196,297 | A | 3/1993 | Dombrowski, Jr. et al. |
| 5,214,750 | A | 5/1993 | Minowa et al. |
| 5,266,550 | A | 11/1993 | Asajima et al. |
| 5,284,816 | A | 2/1994 | Stephenson |
| 5,319,392 | A | 6/1994 | Durst et al. |
| 5,339,099 | A | 8/1994 | Nureki et al. |
| 5,366,952 | A | 11/1994 | Granquist |
| 5,398,305 | A | 3/1995 | Yawata et al. |
| 5,428,714 | A | 6/1995 | Yawata et al. |
| 5,437,004 | A | 7/1995 | Miyasaka et al. |
| 5,555,349 | A | 9/1996 | Miyasaka et al. |
| 5,584,590 | A | 12/1996 | Ito et al. |
| 5,594,653 | A | 1/1997 | Akiyama et al. |
| 5,629,259 | A | 5/1997 | Akada et al. |
| 5,639,169 | A | 6/1997 | Aruga |
| 5,677,722 | A | 10/1997 | Park |
| 5,688,057 | A | 11/1997 | Wright et al. |
| 5,692,110 | A | 11/1997 | Miyasaka et al. |
| 5,707,925 | A | 1/1998 | Akada et al. |
| 5,710,094 | A | 1/1998 | Minami et al. |
| 5,755,521 | A | 5/1998 | Ito et al. |
| 5,756,188 | A | 5/1998 | Reiter et al. |
| 5,763,356 | A | 6/1998 | Ueno et al. |
| 5,781,823 | A | 7/1998 | Isobe et al. |
| 5,789,340 | A | 8/1998 | Brust et al. |
| 5,794,530 | A | 8/1998 | Dobashi et al. |
| 5,800,081 | A | 9/1998 | Teradaira et al. |
| 5,815,191 | A | 9/1998 | Michielsen et al. |
| 5,846,900 | A | 12/1998 | Reiter et al. |
| 5,876,836 | A | 3/1999 | Imamura et al. |
| 5,883,043 | A | 3/1999 | Halbrook, Jr. et al. |
| 5,886,725 | A | 3/1999 | Miyadera et al. |
| 5,918,910 | A | 7/1999 | Stillwagon et al. |
| 5,964,541 | A | 10/1999 | Murison et al. |
| 6,000,867 | A | 12/1999 | Yoshii et al. |
| 6,095,414 | A | 8/2000 | Long et al. |
| 6,130,185 | A | 10/2000 | Narita et al. |
| 6,150,067 | A | 11/2000 | Koike et al. |
| 6,151,037 | A | 11/2000 | Kaufman et al. |
| 6,210,777 | B1 | 4/2001 | Vermeulen et al. |
| 6,350,072 | B1 | 2/2002 | Nunes et al. |
| 6,388,692 | B1 | 5/2002 | Iwata et al. |
| 6,523,951 | B2 | 2/2003 | Takeya et al. |
| 6,562,755 | B1 | 5/2003 | Halbrook, Jr. et al. |
| 6,705,786 | B2 | 3/2004 | Trovinger |
| 6,759,366 | B2 | 7/2004 | Beckerdite et al. |
| 6,784,906 | B2 | 8/2004 | Long et al. |
| 6,786,263 | B1 | 9/2004 | Fox, Jr. et al. |
| 6,801,233 | B2 | 10/2004 | Bhatt et al. |
| 6,812,943 | B1 | 11/2004 | Day et al. |
| 6,906,735 | B2 | 6/2005 | Bhatt et al. |
| 6,982,737 | B2 | 1/2006 | Elko et al. |
| 7,589,752 | B2 | 9/2009 | Janning |
| 7,623,145 | B2 | 11/2009 | Taguchi |
| 7,839,425 | B2 * | 11/2010 | Morrison ..... 347/171 |
| 2003/0025779 | A1 | 2/2003 | Miyazaki |
| 2005/0164881 | A1 | 7/2005 | Kenney et al. |
| 2006/0072001 | A1 | 4/2006 | Klein |
| 2006/0289633 | A1 | 12/2006 | Moreland et al. |
| 2007/0280767 | A1 * | 12/2007 | Iwasaki ..... 400/76 |

FOREIGN PATENT DOCUMENTS

| | | |
|---|---|---|
| EP | 1 862 318 | 12/2007 |
| EP | 1 862 319 | 12/2007 |
| EP | 1862319 | * 12/2007 |
| GB | 2 250 478 A | 4/2010 |
| JP | 58051172 | 3/1983 |

OTHER PUBLICATIONS

JP Abstract, vol. 007, No. 081 (M-105), Apr. 5, 1983 & JP 58-008668 A (Shinko Denki KK), Jan. 18, 1983.

JP Abstract, vol. 015, No. 194 (M-1114), May 20, 1991 & JP 03-051149 A (Fujitsu General Ltd), Mar. 5, 1991.

JP Abstract, vol. 2000, No. 24, May 11, 2001 & JP 2001-199095 A (Alps Electric Co. Ltd.), Jul. 24, 2001.

JP Abstract, vol. 1998, No. 08, Jun. 30, 1998 & JP 10-076713 A (Sony Corp.), Mar. 24, 1998.

JP Abstract, vol. 010, No. 151 (M-483), May 31, 1986 & JP 61-003765 A (Konishiroku Shasin Kogyo KK), Jan. 9, 1986.

JP Abstract, vol. 016, No. 041 (M-1206), Jan. 31, 1992 & JP 03-246091 A (Canon Inc.), Nov. 1, 1991.

Boca Systems Micro Plus 2S 2 Sided Printer product brochure, which came to the attention of Applicant at a Chicago tradeshow during the summer of 2002.

APTi PowerEco T R2412 printer brochure, which came to the attention of Applicant in the summer of 2007, and was translated by Applicant's Japanese office in the fall of 2007.

European Search Report mailed Dec. 15, 2009 for EP Application No. 09168578.4-1251.

* cited by examiner

METHOD OF CONTROLLING THERMAL PRINTING

CROSS-REFERENCE TO RELATED APPLICATIONS

This application is a continuation of application Ser. No. 12/211,974, filed Sep. 17, 2008 now U.S. Pat. No. 7,839,425.

BACKGROUND

While printing a document, a thermal printer may experience one or more types of printing errors. For example, the printer may print too light or too dark for the type of information being printed. Further, for thermal printers that print on two sides of a document, the printer may experience a thermal print head power distribution failure when the printer is simultaneously printing on two sides.

For an example, travel documents such as airline boarding passes or rental car coupons typically include printed characters, traveler personal data, flight or rental car data and/or machine readable data such as a barcode. A thermal printer may print these data too light. When the travel documents are two-sided documents, a rear or secondary side may include a road map, way-finder data, or corporate logo, all with heavy segmented printing, i.e., solid print areas. The printer may print these solid print areas too dark. Both overly light and dark printing negatively affect the readability of printed documents.

It would be advantageous to provide a method of controlling thermal printing that controls print quality based upon the type of information being printed and prevents thermal print head power distribution failure when printing on two sides.

SUMMARY

A method of controlling thermal printing is provided.

The method includes receiving pre-formatted data representing information to be printed on two sides of a thermal print media from a computer by a processor of a thermal printer, analyzing the pre-formatted data by the thermal printer to determine different types of data to be printed with different print densities by the processor, determining an average print density of the different print densities by the processor, determining that the average print density is greater than a predetermined average print density by the processor, determining a power level required to print the data, and directing first and second thermal print heads to print the data based upon the required power level by the processor.

DETAILED DESCRIPTION

Figure 1:
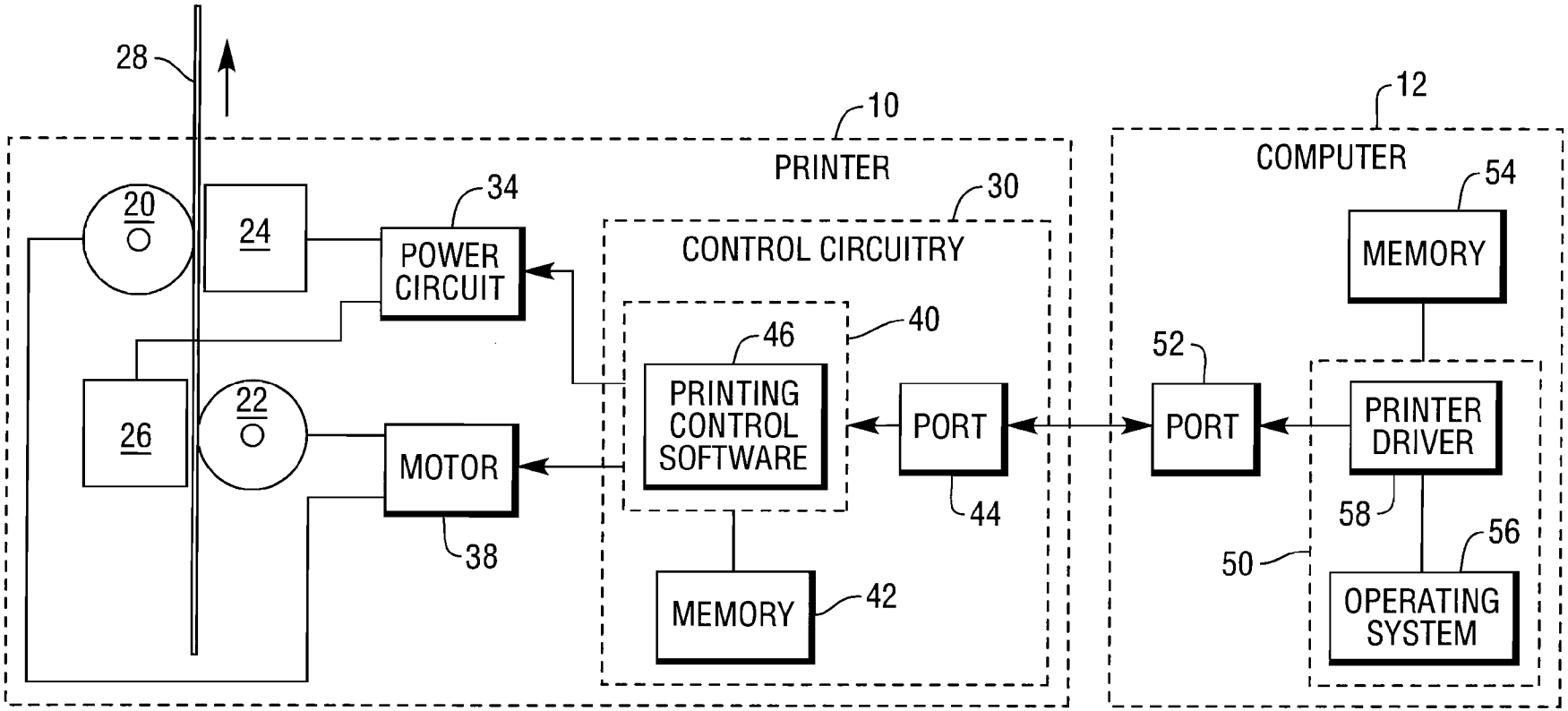
FIG. 1 shows a schematic of an example printing system.

With reference to FIG. 1, example printer 10 includes a direct thermal printer. The illustrated printer 10 is useable for printing on two sides of thermal print media 28. However, direct thermal printers which print only on one side of thermal print media 28 are also envisioned for use with the present invention.

Example printer 10 includes rotating platens 20 and 22 on opposite sides of thermal print media 28. Motor 38 rotates platens 20 and 22, for example, through gears affixed to platens 20 and 22, to feed print media 28. An additional motor may be used to separately drive platen 20.

Example printer 10 further includes opposing thermal print heads 24 and 26 on opposite sides of thermal print media 28.

Power circuit 34 provides power to thermal print heads 24 and 26. Alternatively, an additional power circuit may be used to separately power thermal print head 26.

Direct thermal printing of thermal print media 28 may occur in a single pass at, for example, completion of a transaction such as when a receipt or ticket is issued. Alternatively, direct thermal printing may occur in a two or more pass process where, for example, thermal print media 28 is imaged by one or both thermal print heads 24 and 26 when moving in a first direction, and then retracted for further imaging by one or both thermal print heads 24 and 26 with thermal print media 28 moving in either the first or a second, retract direction. Once printing is completed, thermal print media 28 may, depending on its format (for example, roll, fan fold, individual sheets, and the like), be manually or automatically cut or severed to provide an individual receipt, ticket, or other document.

Thermal print media 28 includes thermal paper, such a thermal paper having a cellulosic or polymer substrate sheet and heat sensitive dyes. Printing on opposite sides of thermal print media 28 can be facilitated by including a substrate sheet that is sufficiently thermally resistant to inhibit thermal printing on one side of thermal print media 28 from affecting coloration on the opposite side of thermal print media 28.

Thermal print media 28 may be supplied in the form of a paper roll, fan-fold stack, individual sheet and the like, upon which printing such as graphics or text, or both, may be printed on one or both sides of thermal print media 28, to provide, for example, a voucher, coupon, receipt, ticket or other article or document.

Example printer 10 further includes control circuitry 30, which controls printing by print heads 24 and 26, including power delivered by power circuit 34, and speed of motor 38.

Control circuitry 30 may include a processor or CPU 40, a memory 42, and a communications port 44 for communicating with one or more host or auxiliary computers 12 such as a POS terminal, travel kiosk computer, or other self-service or assisted-service terminal for input of data to, and output of data from, printer 10.

Processor 40 executes printer control software 46, which analyzes pre-formatted print data from computer 12 and controls density of printed information on print media 28 based upon the analysis. Print density is a measure of print quality and may be defined as the relative darkness of print on the page or print contrast. Optimal print density would result in a clean legible document with easy to read characters, numerals, and/or graphics, without smudges or undesired grayscale characters or graphics.

For example, barcode readers measure the difference between narrow and wide areas and dark and light areas of a barcode. Barcode readers would have difficulty recognizing and decoding barcodes printed with insufficient contrast. Thus, there are limits as to how much barcode contrast can be manipulated during printing and still result in a readable barcode.

Communications port 44 may support communications between printer 10 and computer 12 in the form of RS-232 serial, parallel, universal serial bus, Ethernet and/or wireless communications (for example, 802.11, 802.15, and IR), among others. Communications may be un-directional or bi-directional.

Data for printing may typically be supplied by computer 12. Computer 12 includes a processor or CPU 50, memory 52, and communications port 54. Processor 50 executes an operating system 56 and a printer driver 58. An example operating system 56 may include a windowing operating system, such as one provided by Microsoft.

Computer 12 may include a host POS terminal, kiosk, or other self-service or assisted-service terminal communicating with printer 10. Supplemental data for printing, such as product and or discount coupon information, directions, road maps, way-finder data, or corporate logos among other types of data can also be supplied by, for example, a network server providing data directly to printer 10, or indirectly through the host POS terminal, kiosk, or other self-service or assisted-service terminal. The supplemental data for printing may vary depending upon the goods or services sold or provided.

Printer driver 58 converts information to be printed into a format and/or language that printer 10 understands. For example, printer driver 58 may convert the information into raster graphics format. Printer driver 58 may also configure printer 10 based upon selections available to an operator through a graphic user interface (GUI) associated with printer driver 58.

Printer driver 58 may be separate from or part of operating system 56 or an application program that also works with operating system 56. An example printer driver 58 may be supplied with printer 10 by a manufacturer of printer 10.

Printer 10 and computer 12 may be separate from each other or combined in a single enclosure, such as a kiosk enclosure.

Computer 12 may additionally include or be connected to peripherals supportive of its purpose. For example, if computer 12 is part of a travel kiosk, computer 12 may be coupled to a barcode reader, passport reader, and card reader. As another example, if computer 12 is part of a self-service or assisted-service checkout station, computer 12 may be coupled to a barcode reader, produce scale, card reader, cash acceptor and/or dispenser or cash drawer, and personal identification number (PIN) keypad.

In more detail, printer control software 46 allocates and distributes required thermal print head power from power circuit 34, and varies the speed of drive motor 38 throughout printing based upon the average print density of the information that is being printed. Printer control software 46 determines average print density in print data received from printer driver 58, for example, in raster graphics format.

For two-sided printing, printer driver 58 sends first information to be printed on a primary side separately from second information to be printed on a secondary side of media 28. Printing on primary and secondary sides of media 28 may occur in one printing cycle, or in two sequential printing cycles. For each side of information, printer control software 46 determines average print density and power required to print.

In an example implementation, printer control software 46 includes three ranges of average print densities: (a) less than about 30% (b) greater than about 30% but less than about 39% or (c) greater than about 40% with required power (i) less than about 80% of available power or (ii) greater than about 80% of available power.

If average print density is less than 30%, printer control software 46 prints both sides with no changes in power or platen speed control from normal power and speed.

If average print density is greater than 30%, but less than 40%, printer control software 46 prints both sides simultaneously using normal power but reduces platen speed.

If average print density is greater than 40%, and power required to print is less than 80% of total available power, printer control software 46 prints both sides simultaneously using normal power but reduces platen speed.

If power required to print exceeds 80% of total available power, printer control software 46 ensures that only a single print head, for example, print head 24, is energized and printing at one time and that all available power is diverted to the single print head.

After the primary side has printed, printer control software 46 pauses printing, then automatically reverses media 28 until the leading edge is properly positioned for secondary side printing. Printer control software 46 then prints the secondary side. During secondary side printing, printer control software 46 controls power to the print head responsible for secondary side printing, for example, print head 26, to ensure that the secondary side information is printed with adequate print density.

Alternatively, printer 10 may print the secondary side first and the primary side last, depending on which print head is physically located closer to the paper feed source, so as to minimize total paper length travel and feed jams. After both print cycles are complete, printer control software 46 moves media 28 to a position for delivery, knife cut, or further mechanical transport.

Figure 2A:
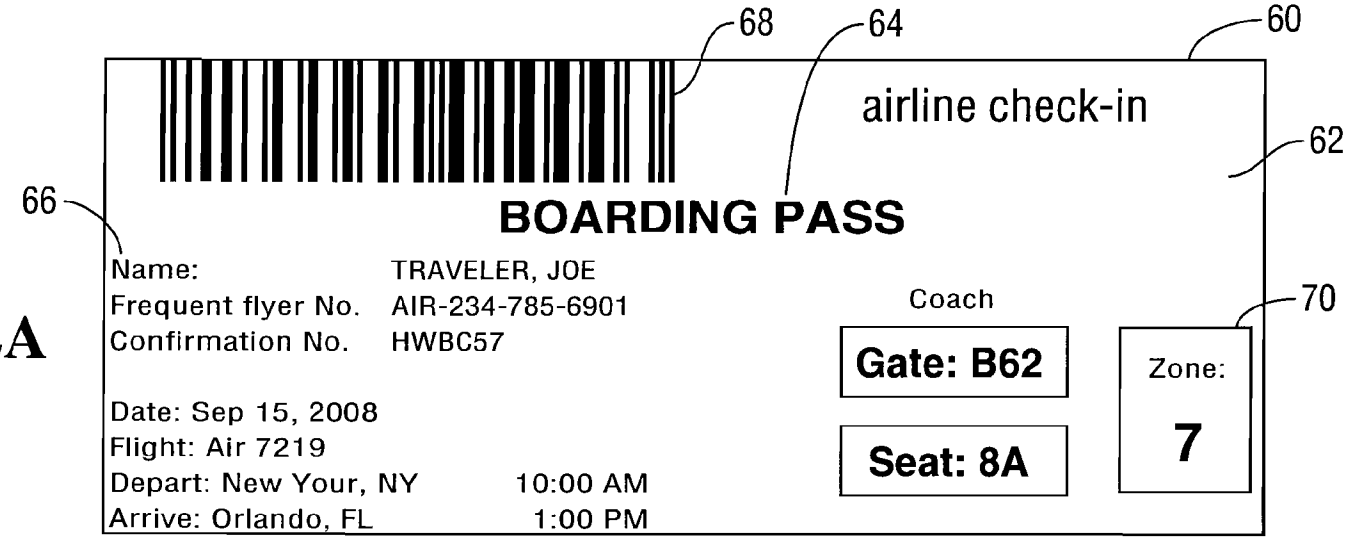
FIGS. 2A and 2B show an example document from the printer of FIG. 1.
Figure 2B:
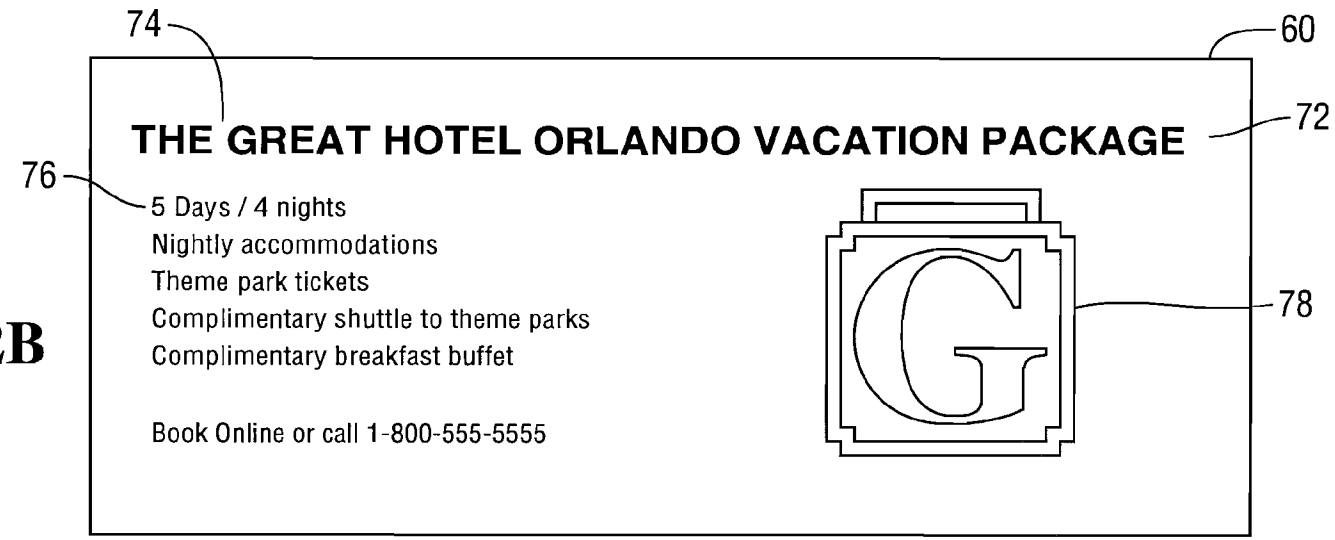

FIGS. 2A and 2B illustrate two sides 62 and 72 of a two-sided thermal document 60 in the form of a travel document, including a boarding pass.

Primary side 62 requires different types of information printed in different density levels. For example, side 62 includes text 64, "BOARDING PASS", which is printed in a bolder font than text 66. Side 62 additional includes a barcode label 68 which includes bars of varying degrees of thickness and graphic boxes 70.

Secondary side 72 contains an advertisement. As with side 62, side 72 contains different types of text 74 and 76. Side 72 additional contains a logo 78 for the hotel in the advertisement.

For sides 62 and 72, printer control software 46 would determine that the average print density would be less than 30% and the power required to print would be less than 80% of available power. Therefore, printer control software 46 prints both sides 62 and 72 at the same time.

Other types of documents 60 may include other types of information related to the transactions involved. For example, the information may include further or duplicate transaction information, a coupon (as shown), rebate or contest information, serialized cartoons, conditions of sale, document images, advertisements, security features, ticket information, legal information such as disclaimers, warranties and the like, among other information. Further, the information may be targeted based on recipient or purchaser identity, transaction data, transaction detail, store inventory or specials, manufacturer inventory or specials, and the like, or randomly selected from a database of possible options, among other means.

Advantageously, the printing control method improves document clarity and readability. The printing control method additionally extends the life of print head power circuits by ensuring that the power delivered to thermal print heads 24 and 26 is within manufacturer recommendations. The printing control method may additionally result in faster printing and document delivery. Printing primary and secondary sides separately at required print power and full platen forward/reverse speed may be faster than printing at the lowest allowed speed and at reduced print power. Finally, the printing control method may deliver printed barcodes with higher first pass read rates.

Although particular reference has been made to certain embodiments, variations and modifications are also envisioned within the spirit and scope of the following claims.

What is claimed is:

1. A printer control method comprising:

receiving print data representing information to be printed on two sides of a thermal print media from a computer by a processor of a thermal printer;

analyzing the print data to determine print densities to be printed by the thermal printer; and directing the thermal printer to print the print data based upon the print densities of the print data.

2. The method of claim 1, wherein the print media becomes a boarding pass after printing.

3. The method of claim 1, wherein the print media becomes a travel document after printing.

4. The method of claim 1, wherein the print media becomes a receipt after printing.

5. The method of claim 1, wherein the print data comprises a barcode.

6. The method of claim 1, wherein the print data comprises a coupon.

7. The method of claim 1, wherein the print data comprises a map.

8. The method of claim 1, wherein the print data comprises a company logo.

9. A printer comprising:

a first print head for printing on a first side of a thermal print media;

a second print head for printing on a second side of the thermal print media;

first and second drive platens for moving the thermal print media past the first and second thermal print heads during printing; and a receiving subcomponent that receives print data representing information to be printed on two sides of a thermal print media from a computer by a processor of a thermal printer;

an analysis subcomponent that analyzes the print data to determine print densities to be printed by the thermal printer; and a directing subcomponent that directs the thermal printer to print the print data based upon the print densities of the print data.

* * * * *